United States Patent [19]

Paley

[11] 4,083,732

[45] Apr. 11, 1978

[54] SUGAR JUICE TREATMENT

[76] Inventor: Lewis A. Paley, 614 Adams St., Aurora, Ill. 60505

[21] Appl. No.: 424,713

[22] Filed: Jan. 11, 1965

[51] Int. Cl.[2] ..... C13D 3/16; C13D 3/06; C13D 3/12

[52] U.S. Cl. ..... 127/48; 21/58; 127/10; 127/11; 127/46 R; 127/50; 127/54; 127/58; 127/55; 127/61; 210/23 H

[58] Field of Search ..... 127/10, 54, 41, 44, 127/46, 48–58; 210/23, 48, 40

[56] References Cited

U.S. PATENT DOCUMENTS

| | | | |
|---|---|---|---|
| 43,065 | 6/1864 | Dubrunfaut | 127/10 |
| 237,835 | 2/1881 | Dubrunfaut | 127/54 X |
| 665,116 | 1/1901 | Kohn | 127/10 |
| 733,174 | 8/1902 | Engel | 210/268 |
| 744,764 | 10/1902 | Kathol | 210/268 |
| 1,314,203 | 8/1919 | Mumford | 127/46 |
| 1,889,779 | 12/1932 | Ebert et al. | 204/138 |
| 1,989,156 | 1/1935 | Sanchez | 127/48 |
| 2,405,315 | 8/1946 | McBride | 127/48 |
| 2,557,996 | 6/1951 | Peterson | 127/44 |
| 2,633,346 | 3/1953 | Stein | 263/21 |
| 2,647,058 | 7/1953 | Schapiro | 99/105 |
| 2,688,572 | 9/1954 | Warshaw | 127/54 |
| 2,776,229 | 1/1957 | Peterson | 127/48 |
| 2,831,773 | 4/1958 | Geisler | 99/105 |
| 2,860,091 | 11/1958 | Rosenberg | 204/138 |
| 3,197,030 | 7/1965 | Black | 210/400 |
| 3,228,876 | 1/1966 | Mahon | 127/54 X |
| 3,244,621 | 4/1966 | Bouthilet | 210/40 |
| 3,252,899 | 5/1966 | Rice et al. | 210/40 |
| 3,307,704 | 3/1967 | Pashaian et al. | 210/400 |
| 3,307,840 | 3/1967 | Conroy | 263/21 |

FOREIGN PATENT DOCUMENTS

| | | | |
|---|---|---|---|
| 249,191 | 3/1926 | United Kingdom | 127/52 |

OTHER PUBLICATIONS

Zerban, F. W., Int. Sug. J., 1920, pp. 332–333, 643–646, 699–702.

Honig, P., Principles of Sugar Technology, N. Y., 1953, pp. 447–450, 492–495, 501–503, 560, 572–573, 596–598.

C. E. Bessemer, "A New System. . . Sugar", London, 1852, p. 21.

K. S. Gururaja Doss et al., "Activated Carbon from Wax-Free Press Mud", *Indian Sugar*, p. 149, (1944).

*Primary Examiner*—Sidney Marantz

[57] ABSTRACT

Method of treating fresh sugar juice at about room temperature which includes removing non-sugar impurities, concentrating the resulting cold, water white juice by reverse osmosis to form a syrup which is evaporated to form direct white sugar and edible molasses. Also a method of treating sugar cane juice with oxalic acid.

8 Claims, 9 Drawing Figures

SUGAR JUICE TREATMENT

This invention relates to the purification and treating of liquids in general, including sugar juice and sewage plant effluent water.

The invention further relates to new products and suitable apparatus for carrying out the purification methods and means.

Cane sugar juice contains cane wax with a melting point of 175° F. In the present cane sugar manufacturing method, the juice is limed and then heated to boiling which melts the wax, throws it into solution and unavoidably causes the production of raw sugar and blackstrap molasses. The wax makes the raw sugar "raw." The raw sugar is then generally sent to a distant refinery to be remelted and refined to produce white sugar. In the method herein disclosed, I remove the wax and other impurities from the juice at room temperature to produce a water white juice free of wax. The juice is then evaporated to form direct white sugar and edible molasses, no refining of sugar being required and no black strap molasses is produced.

In fresh juice from the mill, there is a natural cleavage between sugar and non-sugar impurities. If this cleavage is not destroyed by improper processing, clarification to water white juice is easy with the result that direct white sugar and edible molasses are produced upon evaporation or concentration of the juice. Fresh cane juice is high in bacteria and it is desirable to chlorinate and sterilize the juice so that the natural cleavage will not be destroyed by bacterial action to produce a color in the juice which cannot be removed by active carbon. The chlorine is preferably added to the juice in advance of the carbon treatment so that the carbon acts to remove excess chlorine, remove dead bacteria killed by the chlorine and also acts to combine chemically with the wax to form an insoluble mud containing wax-carbon compound as well as other non-sugar impurities in the juice. Oxalic acid and/or hypochlorites, such as sucro-blanc, may be mixed with the juice in order to lower the pH, bleach the juice or to precipitate excess lime as insoluble calcium oxalate.

An object of the invention therefore, is to produce direct white sugar and edible molasses from fresh sugar cane juice.

Another object of the invention is to remove non-sugar impurities from said juice at room temperature to produce a water white juice before heating said juice.

Another object of the invention is to avoid the loss of large amounts of sugar existing in present black strap molasses.

Another object of the invention is to sterilize the cane juice by chlorination to permit subsequent clarification of the juice to water white condition free of chlorine.

Another object of the invention is to treat the juice with chlorine in advance of carbon treatment so that the carbon acts to remove any excess chlorine and also removes dead bacteria killed by the chlorine.

Another object of the invention is to partly or completely clarify cane juice by filtration at about room temperature.

Another object of the invention is to optionally add $CO_2$, oxalic acid and/or sucro blanc to the juice to aid in producing a water white juice.

Another object of the invention is to treat sewage plant effluent water with chlorine, active carbon and/or lime filtration and heat to purify the water and reclaim it.

Another object of the invention is to produce a molding plastic material from the impurity mud removed from the juice.

Another object of the invention is to provide a combined counter-current mixer for the carbon, a settler and a filter for clarifying the juice.

Another object of the invention is to provide a combination settler and filter for removing impurities, such as albumin from the juice.

Another object of the invention is to provide means for concentrating the water white juice to a syrup by reverse osmosis without the use of expensive evaporation.

Another object of the invention is to provide a filter belt for filtering impurities from the juice, such as bagacillo, field dirt and wax, so as to produce a partly clarified juice.

Another object of the invention is to remove ions from the syrup by electrodialysis so as to produce direct white sugar and edible molasses having a very low ash.

Another object of the invention is to produce new products of manufacture, such as direct white sugar and edible molasses.

A further object of the invention is to provide a suitable apparatus for calcining the mud to regenerate it at no cost to active carbon for recycling, and to produce a solvent by-product of commercial value.

A still further object of the invention is to improve liquid purification methods and apparatus and products of manufacture in other respects hereinafter specified and claimed.

Reference is to be had to the accompanying drawings forming a part of this specification in which FIG. 1 is a flow diagram showing the manner of carrying out my method or process.

Figures 1, 3, 4, 5:
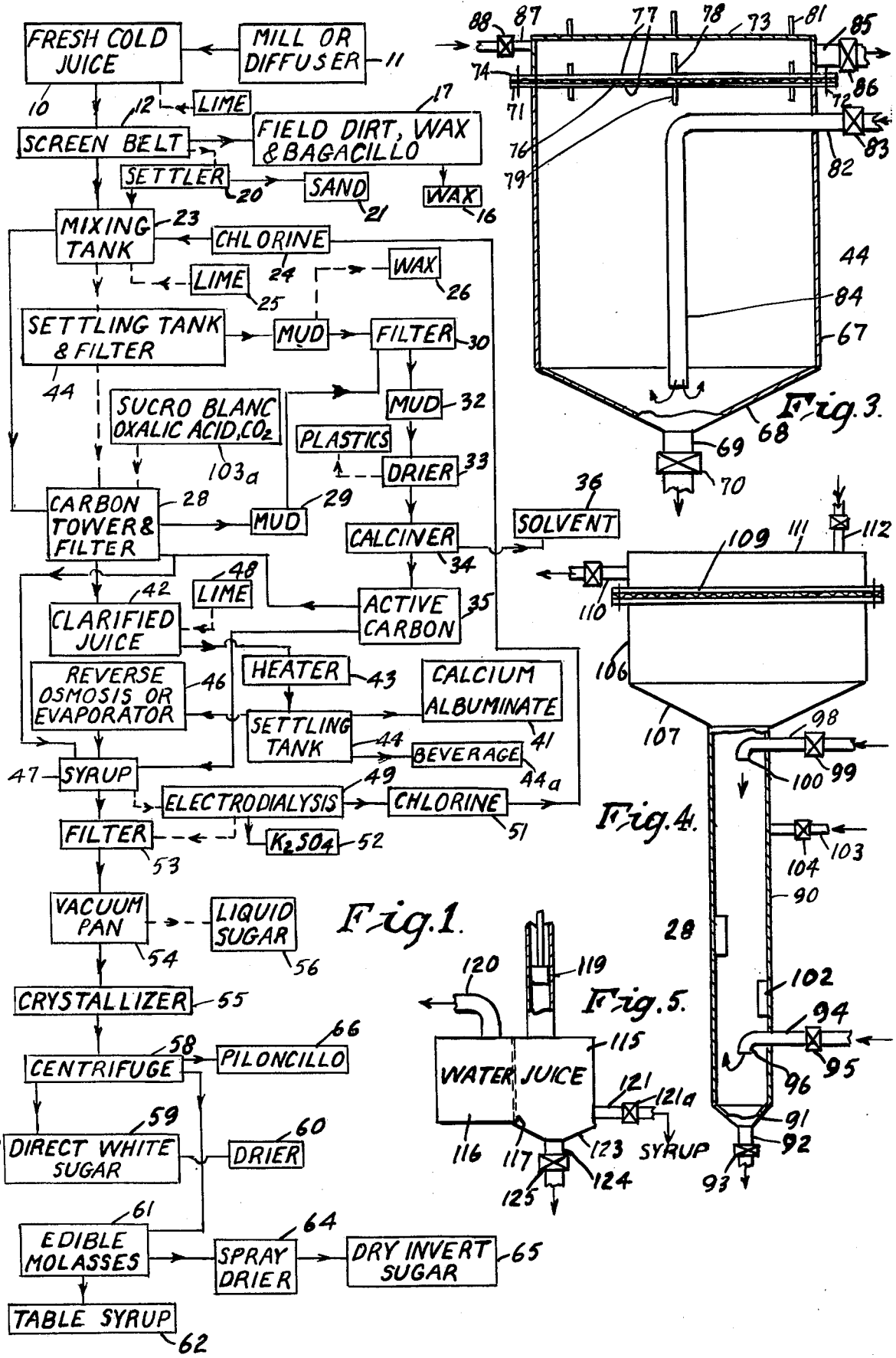
FIG. 3 is a sectional view or elevation of a combination settler and filter for the liquids.
FIG. 4 is a sectional elevation of a tower for mixing the active carbon with the liquid, for settling and removing the mud and for filtering the settled liquid, all in one operation.
FIG. 5, is a diagramatic reverse osmosis apparatus for concentrating the juice to a syrup.

Referring to the drawing by numerals, fresh cane sugar juice 10 is produced by a roller mill or diffuser 11 at room temperature, which will be 20°–40° C at most of the sugar factories. This juice contains bagacillo, field dirt, bacteria, wax, albumin and other non-sugar impurities. This juice is sent to screen belt 12 which is shown more in detail in FIG. 2 and will later be described. This screen belt removes some of the bagacillo, field dirt and wax, the bagacillo being formed in layers 13, 14 and 15 on belt 16 so as to serve as a filtration medium for removing field dirt and wax from the juice as a residue or screenings 17. The wax 16 may be extracted from the residue 17 by solvents such as heptane, hexane and acetone to form a valuable wax by-product used for polishes. The bagacillo and field dirt may be separated by water sedimentation, or dried as a mixture to be mixed with about 15–35% powdered phenol-formaldehyde resin to form a plastic molding compound or pressed board for construction purposes. Dotted lines in the flow diagram indicate optional methods of operation.

If the juice is high in sand and dirt, it now goes to a settler 20 where the sand 21 is removed by sedimentation and decantation. Ordinarily the screened juice from belt 12 will go to a mixing tank 23 where chlorine gas 24 or solution, such as chlorox, is added to the juice until there is a faint odor of chlorine so as to sterilize the juice and kill the bacteria. Lime 25 will also be mixed with the juice in tank 23 to a pH of 7.5–8.5 if wax 26 is to be recovered from the mud by extraction with a solvent. Ordinarily if no wax is to be recovered, the limed juice from tank 23 is sent to a tower 28 (FIG. 4) to be mixed with active carbon preferably in slurry form to coprecipitate an insoluble wax-carbon compound onto the lime precipitate to form a mud 29. This mud 29 is sent to a filter 30 or cyclone separator to separate the solids 32 from the sucrose containing liquid, the latter being returned to the system such as mixing tank 23. The mud 32 now goes to a drier 33 preferably of the rotary type, and the dried mud is sent to a calciner 34 (FIG. 8), to be converted to active carbon 35 and a solvent 36. (See condenser FIG. 9). The regenerated active carbon 35 is recycled through carbon tower 28 and the excess produced may be sold to other industries. Bagasse may be mixed with the mud 32 to increase the volume of active carbon produced to any desired amount. The lime used in the process is also regenerated to CaO in the calciner 34 and is converted to $Ca(OH)_2$ in the quench water in tank 38 (FIG. 1). The mud 29 would thus be a mixture of active carbon and hydrated lime, the latter acting to neutralize the organic acids in the juice. The addition of lime 25 would then not be needed as full neutralization of organic acids in the juice would be accomplished by the regenerated lime at a considerable saving in cost of operation. However, the hydrated lime may be separated from the active carbon by hydraulic classification and fed to the juice at mixer 23 in advance of the active carbon mixing.

If desired, clarification of juice to water white may be accomplished without the use of any lime at all in tower 28 in which case a very pure active carbon 35 will be produced for sale to other industries. In such a lime-free operation, calcium albuminate or albumin 41 is produced in large quantities when the water white juice 42 from tower 28 is heated to boiling in heater 43 and settled in settling tank 44 (FIG. 3). Albumin 41 is suitable for use in cake mixes in the prepared foods industries. The juice from tank 44 is now concentrated either by conventional vacuum evaporation or by reverse osmosis equipment 46 (FIG. 5) to a syrup 47 of about 60° Brix. Lime 48 may be mixed with the water white juice 42 to insure complete precipitation of the calcium albuminate.

The syrup 47 is now optionally subjected to electrodialysis 49 (FIGS. 6 and 7) in order to remove all cations and anions from the juice. The cathode may be of iron and the anode of graphite, and canvas membranes are used around the electrodes to trap the ions. The C1 and $SO_4$ ions go to the anode, chlorine gas 51 being formed at the anode and recirculated in mixing tank 23 to sterilize the fresh juice going into the system. $SO_4$ ions stay in solution at the anode as $H_2SO_4$, and metal ions, principally potassium, collect at the cathode as the hydroxides. The liquids in the electrode bags are mixed to form $K_2SO_4$ 52 which is separated from syrup by fractional crystallization to form fertilizer, the syrup being returned to the system.

The syrup is now optionally hot filtered in pressure filter 53 in the presence of filter aid and active carbon to make a water white syrup which is sent to vacuum pan 54 to be concentrated to a massecuite which is sent to crystallizer 55 to crystallize the sucrose. The liquid product from vacuum pan 54 may be sold as liquid sugar 56. The massecuite is now cooled and the bulk of the light colored edible molasses 61 may be decanted from the sucrose. The balance of the massecuite may be separated in centrifuge 58 to form direct white sugar 59 which is dried in drier 60 and bagged for market. The light colored edible molasses 61 may be further purified by filtration with active carbon etc., and is sold as table syrup 62 having a natural maple flavor. The edible molasses 61 may also be spray dried in drier 64 to form a mixture of dry invert sugar 65 plus some sucrose, to be sold to bakers, confectioners and bottlers. By running the centrifuge 58 at about half speed, the sucrose will still contain some edible molasses and can be loaded hot into molds and cooled to form piloncillo 66. The direct white sugar 59 and edible molasses made by electrodialysis 49, will have about zero ash so that the white sugar will compete directly with refined white sugar made by the conventional hot process of clarification. The ash free edible molasses is entirely new to the sugar industry and contains all the natural invert sugar contained in the original juice. The apparatus used will now be described more in detail.

The combination settler and filter 44 shown in FIG. 3 consists of a tank or shell 67 having a frusto conical bottom 68, terminating in a bottom discharge pipe 69 having a valve 70. At the top of tank 67 is an outstanding annular flange 71 for receiving bolts 72. A closed cover 73 extends over the top of tank 67, said cover having an outstanding annular flange 74 secured to the flange 71 by bolts 72. A filter disc 76 extends between flanges 71 and 74, said disc being composed of polypropyene cloth, dacron cloth, canvas or other suitable filtering material. A wire mesh 77 of about 4 inch sq. extends on each side of the filter 76 to reinforce same against pressure up or down. Reinforcing angles 78 are secured to the inside of tank 67. The wire meshes 77 may be welded to the angles 78 and 79. Reinforcing angles 81 are welded to the cover 73. A juice inlet pipe 82 having a valve 83 extends through the side of tank 67 and then downwardly to form leg 84 to a point substantially above the bottom 68. A sludge blanket is formed adjacent the bottom of pipe leg 84 which helps to induce settling. A filtered juice outlet pipe 85 having a valve 86 is connected to the cover 73 to convey the filtered juice to a discharge point. An air or juice inlet pipe 87 having a valve 88 is also secured to the cover 73. The air or juice valve 88 is preferably a solenoid valve and is operated by a timer, not shown, to momentarily open the valve 88 as every thirty minutes, and introduces compressed air or juice above the filter 76 to discharge the cake from the bottom of said filter. The discharged cake will be in 4 inch squares the size of the mesh 77 and these square pieces of filter cake will settle downwardly and be discharged through pipe 69 with the rest of the mud. A wet vacuum pump, not shown, is preferably connected to the pipe 85 to create a vacuum above the filter. With pressure of about 20 p.s.i. in pipe 82 and vacuum above the filter 76, a high filtration rate will be maintained. Suitable rubber gaskets are provided between flanges 71 and 74 to make a tight seal about the edges of filter 76. This settler-filter 44 may be used for separating albumin 41 to remove all suspended matter from the juice.

The tower 28 is composed of a shell 90, having a frustroconical bottom 91 terminating in a mud outlet pipe 92 having a valve 93. A juice inlet pipe 94 having a valve 95 extends into the shell 90 substantially above the bottom 91 and has an elbow 96 extending downwardly to discharge the juice into the bottom of the shell and not plug up with solids. The valve 93 may be a solenoid valve operated periodically by a timer to deliver mud from the bottom of shell 90. A carbon slurry pipe 98 having a valve 99 extends into the shell 90 and has a downwardly extending elbow 100. Active carbon suspended in water white juice is pumped into the shell 90 through pipe 98 by a metering pump from a carbon and juice mixing apparatus, not shown. All metal parts exposed to the liquid should be protected with bituminous or epoxy paint because of the highly corrosive nature of the carbon in a liquid. Spiral baffles 102 are secured in the inside of shell 90 to give a slight rotary motion to the juice flowing upwardly through said shell to accomplish a mixing of the carbon and the juice or other liquid. A dosing pipe 103 having a valve 104 extends into the shell so that dosing agents **103*a* may be introduced into the shell from the group consisting of lime, oxalic acid, sucro blanc, hypochlorites or $CO_2$ to cause precipitates, to bleach the juice or to modify the pH of the juice. A large diameter chamber 106 is provided above the shell 90 and is connected by a frusto-conical section 107 to said shell. The upward velocity of the juice is greatly reduced in section 106 due to the larger diameter so as to induce settling of suspended matter in the juice or other liquid. The solids settled out in section 106 settle downwardly through the juice and are discharged through outlet pipe 92 with the rest of the mud. The upper end of section 106 is provided with filter 109, outlet pipe 110 and cover 111, wet vacuum pump and air intake pipe 112 and the construction is the same as the upper part of the apparatus in FIG. 3, so its description will not be repeated. This construction provides for the intermittent discharge of filter cake squares from the bottom of filter 109 to pass out through outlet pipe 92 with the rest of the mud. The zone between elbows 96 and 100** is a counter-current mixing zone. The freshest carbon treats the purest juice at the top of the zone. Juice of maximum clarity can be secured and the active carbon is spent to exhaustion. This efficient tower may also be used for the clarification of beet sugar juice to give a water white juice in a single operation.

In FIG. 5 is illustrated a diagrammatic sectional elevation of an apparatus for concentrating the sugar juice from about 16°–23° Brix to a syrup of 60° Brix without evaporation. The apparatus consists of a juice chamber 115 adjoining a water chamber 116 with a permeable membrane 117 between the two chambers. This membrane is composed of a cellulose acetate or other suitable material which has the property of retaining sugar in chamber 115 when pressure is applied by pump 119 and allowing the water to pass into chamber 116 to discharge through pipe 120. The concentrated syrup is withdrawn from chamber 115 through a discharge pipe 121 having a valve **121*a*. A maximum pressure of about 1,500–2,500 p.s.i. is used in chamber 115 to secure a syrup of about 60° Brix. This equipment saves an enormous amount of heat needed in the vacuum evaporation of my water white juice. It also induces the formation of minor non-sugar precipitates which are collected in a bottom collecting pan 123, having a discharge pipe 124 and valve 125**. Through the use of this equipment, bagasse ordinarily used as fuel under the steam boilers is available for the manufacture of active carbon to be sold to the various industries. The lime used in the process helps to activate the bagasse during calcination to form active carbon.

Figure 2:
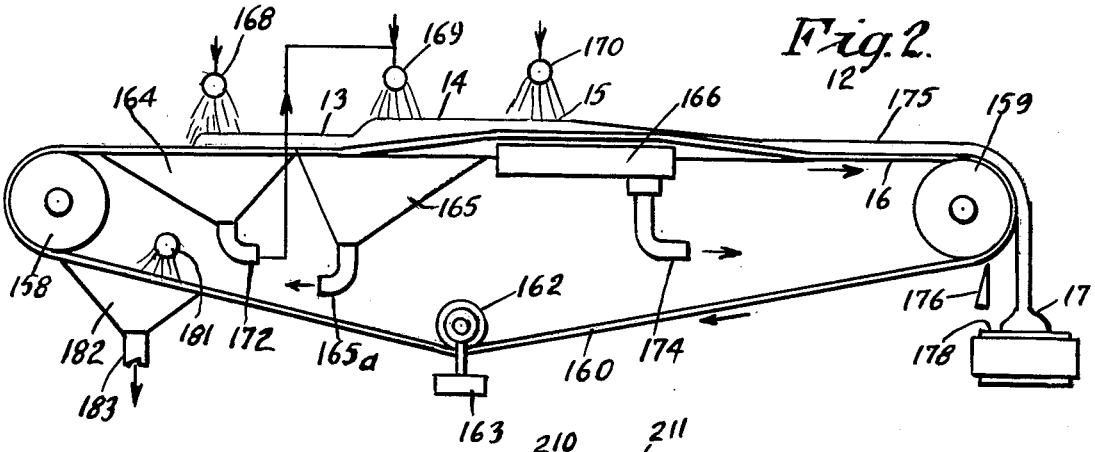
FIG. 2 is a side elevation showing a screen or filter belt for screening or filtering the sugar juice or other liquid.

In the apparatus of FIG. 2, a filter belt 16 of woven polypropylene, canvas, muslin or other cloth, is constructed of the desired width, 52 inches being a standard width. This belt 16 may also be made of 80–120 stainless steel wire. The belt 16 passes around two rollers 158 and 159, the latter being driven very slowly, such as 1 R.P.M., by a motor and speed reducer. The lower reach 160 of belt 16 is engaged by a central idler roller 162 provided with a suspended weight 163 for maintaining a uniform tension in the belt 16, and to provide space for filtrate recovery pans 164, 165 and 166. The rollers 158 and 159 preferably have curved ends which the belt overlaps to produce proper tracking of the belt 16. A plurality of juice inlet spray pipes 168, 169 and 170, are positioned above the belt 16 to lay down a plurality of layers of bagacillo on the belt 16 which act as a precoat filter aid to retain field dirt, wax etc. on a rather coarse mesh fabric, such as 80 mesh. An outlet pipe **165*a* is provided on the collector pan 165. Limed juice from the liming tank 23 contains a voluminous precipitate of albuminoids etc. which also helps to entrap the field dirt and wax on the bagacillo precoat and form a good, somewhat porous filter cake residue or mud 17. A tapered filtrate collecting pan 164 extends under the spray 168 to collect the filtrate and deliver the filtrate from a bottom outlet pipe 172 to a pump not shown to recirculate this filtrate back to spray 169 for refiltering. The spray 168 thus acts as a precoat spray. A tapered collecting pan 165 extends under the the spray to collect clear filtrate from spray 169. Spray 169 will not only handle recirculated filtrate from spray 168 but also original juice from liming tank 23. Filtrate from spray 168 will be somewhat cloudy until a precoat cake is established on top of belt 16. Additional main flow sprays 170 similar to 169 may be used if desired. The sprays tend to disturb the cake on top of belt 16 as little as possible as the bagacillo has a tendency to float on top of the juice. Bagacillo is a fibrous cane material here used as a filtration medium and more can be added to the juice or belt 16 if desired. Collecting pan 166 is preferably a vacuum box which may be arcuate in cross section to trough the belt somewhat in the area of sprays 169 and 170. Vacuum is applied to the bottom outlet pipe 174 by a wet vacuum pump, such as a gear pump. The vacuum box 166 may be lined with perforated sheet plastic, such as Nylon, to reduce the friction between the vacuum box 166 and the filter belt 16. The action of the vacuum is to draw excess juice from the filter cake and reduce the thickness of the cake 175. The cake 175 discharges from the roll 159 and a knife 176 is positioned adjacent the bottom of roll 159 to insure that no pieces of the cake 175 adhere to belt 16. The cake 175 may discharge onto a belt or screw conveyor 178 which carries the cake 175 to a discharge point, such as drier 33. If desired, juice having different characteristics may be applied by the different sprays 168, 169 and 170. Thus the sprays 168 and 169 may be used for raw juice or limed juice, while the spray 170 may be used for filtering juice from settling tower 28 which may contain a trace of carbon, and the filtrate from pipe 179 will then be water white juice. A well formed filter cake will be deposited on the filter belt 16 by the time it reaches spray 170** so that a very thorough filtration will be provided.

A wash spray 181 is provided above the belt reach 160 to thoroughly wash the filter fabric every revolution and prevent blinding of the meshes of the filter fabric. This spray 181 is important in the filtration of sugar juice because of its difficult filtration characteristics. A collecting pan 182 with a bottom outlet pipe 183 is provided below the belt reach 160 to discharge the wash water from spray 181 to waste.

Figure 8:
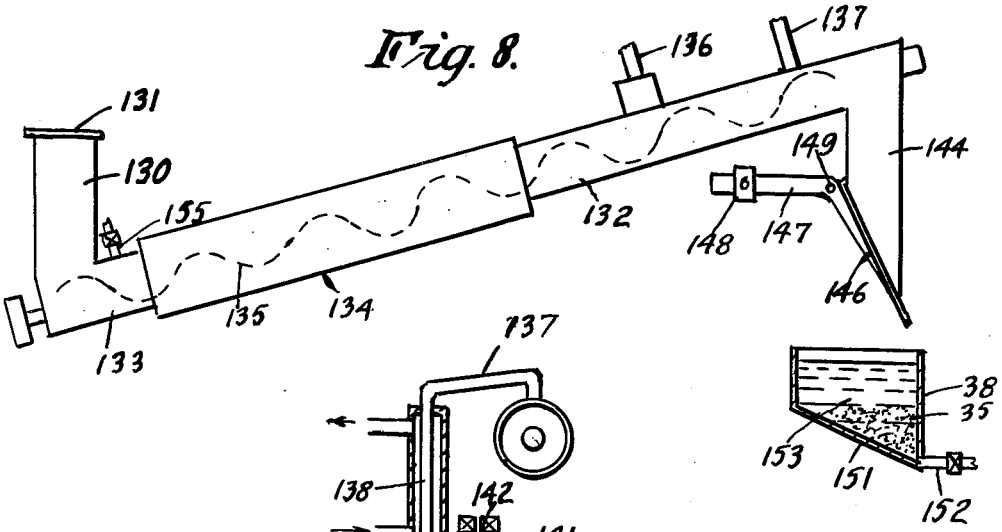
FIG. 8 is a side elevation of a calcining apparatus for regenerating the mud to active carbon.
Figure 9:
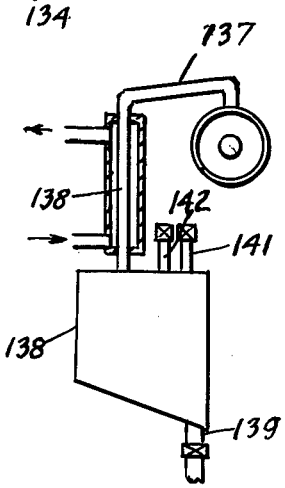
FIG. 9 is an elevation partly in cross section of a condensing and receiving apparatus for the solvent given off during regeneration of the carbon.

In the apparatus shown in FIGS. 8 and 9, the dried mud 32 is sent to calciner hopper 130 having a removable cover 131, said hopper being provided at its lower end with a tubular housing 132 preferably but not necessarily arranged with its axis at an inclination to the horizontal. A ribbon screw conveyor 133 is rotatably mounted in the housing 132 and is preferably provided with reversing mixing paddles to mix the mud as it is calcined. The inclination of the housing insures that the lower end of the housing will be full of material at all times to give a more thorough air treatment. An electric heating unit 134 is positioned around the housing 132 and is operated on and off by a thermostat 136 to maintain a temperature inside the calciner of 250°–600° C., 500° F. being preferred, to accomplish the destructive distillation of the impurities in the mud, to drive off volatile matter and produce active carbon 35. A low vacuum of 5–10 in. is maintained inside the housing 132 through condenser pipe 137 so as to draw off vaporous products of calcination through a water cooled condenser 138 where a high volatile solvent 36 is condensed and flows into receiver **138*a* having a valved outlet pipe 139 for withdrawing solvent at intervals. A valved vacuum line 141 and a valved vent pipe 142 is also provided at the top of receiver 138**.

At the upper end of housing 132 there is provided a hopper 144 extending downwardly for receiving the hot active carbon conveyed up the incline by conveyor 135. An inclined door 146 having a horizontal arm 147 and adjustable weight 148 is hingedly connected by pin 149 to the bottom of hopper 144. A tank 38 is provided below the hopper 144, said tank having an inclined bottom 151 with a valved outlet pipe 152 and water 153. When the weight of hot active carbon in hopper 144 overcomes the weight 148, the door 146 opens and discharges the charge of carbon 35 into the water 153 to suddenly cool it and not allow it to burn by exposure to air. The door 146 and lid 131 maintain the vacuum inside the housing 132. A valved air inlet pipe 155 permits a regulated amount of about 12½% by weight of air to pass through the housing 132 to accomplish a partial oxidation of the mud being calcined and activate the carbon and produce internal exothermic heat. Superheated steam may also be drawn in through pipe 155. The air makes the calcination somewhat exothermic so that little or no heat be supplied by the heating element 134, said element being largely for temperature control purposes.

Figure 7:
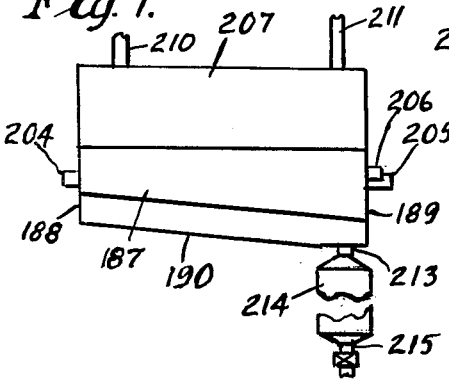
FIG. 7 is a side elevation of the apparatus shown in FIG. 6.
Figure 6:
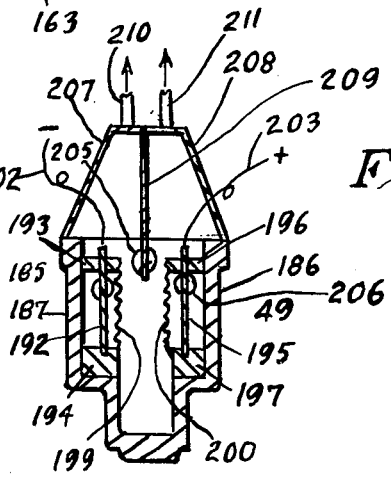
FIG. 6 is a sectional elevation through an electrodialysis apparatus for removing ions from the syrup.

In the syrup electrodialysis apparatus shown in FIGS. 6 and 7, a rectangular box 185 has side walls 186 and 187 connected by end walls 188 and 189, and a sloping bottom 190. A plate like cathode 192 of iron or other suitable material, is supported in box 185 adjacent the wall 187 by brackets 193 and 194. A plate like anode 195 of graphite is supported adjacent the wall 186 by brackets 196 and 197. Permeable membranes 199 and 200 of about 10 oz. canvas or other suitable material, are supported between the brackets 193 and 194 to form a cathode chamber, and between brackets 196 and 197 to form an anode chamber. Suitable vents are provided in brackets 193 and 196 to permit the escape of chlorine and H gas formed in the anode and cathode chambers respectively. A direct current of 24 to 220 v. is imposed upon the cathode and anode by wires 202 and 203 respectively. A liquid inlet pipe 204 is provided on the box end 188 and an outlet pipe 205 is provided on box end 189 so that the juice flows between the electrodes to be deionized. An outlet pipe 206 is connected to the cathode compartment to permit the alkaline liquor in said cathode compartment to flow out of said compartment to a mixing tank not shown. A similar outlet pipe is provided in the anode compartment to conduct the acid liquors to flow out to said mixing tank. The mixed liquors neutralize each other to form largely $K_2SO_4$ fertilizer which is separated from the sugar syrup by fractional crystallization. The mixed liquids in the mixing tank should be brought to about 7 pH by the addition of suitable acid or alkaline reagents. The syrup will be returned to the system.

Gas collecting hoods 207 and 208 are provided over the box 185 separated by a dividing wall 209 which extends down below the surface of the juice in box 185. An outlet pipe 210 is connected to the hood 207 to conduct hydrogen from the cathode hood to a point of discharge where it is used for the hydrogenation of fats, such as the fatty acids contained in the mud 29. An outlet pipe 211 is connected to the hood 208 to conduct chlorine gas 51 to the mixing tank 23 where it is used for sterilizing the fresh juice. An outlet pipe 213 is connected to the low part of box 185 and said pipe is connected to a mud receiver tank 214 terminating in a bottom valved outlet pipe 215 to trap any sediment produced during the electrolysis of the juice. This electrodialysis apparatus may be used for treating the fresh unclarified juice, the water white juice, the syrup, the liquid sugar and/or the molasses if so desired.

The calcination apparatus shown in FIGS. 8 and 9 may also be used to accomplish a partial oxidation of powdered soft coal at 200°–450° F. by introducing the powdered coal into hopper 130 and opening the air inlet 155 valve wider. This partial oxidation makes the coal soluble in such reagents as 5% NaOH, chlorine bleaching agents such as chlorox and organic solvents such as heptane, hexane, acetone, benzene and others. The products extracted from the oxidized coal are then used in various organic syntheses. Chlorine gas may be introduced into the housing 132 to give a combination oxidation and chlorination reaction.

In FIG. 1, I regard the steps of screening the juice, liming the juice, chlorinating the juice, concentration of the juice by reverse osmosis, countercurrent treatment of the juice with carbon and the electrodialysis of the syrup, as optional steps. These steps serve to improve the quality of the resulting direct white sugar, the liquid sugar and the edible molasses. In its simplest form, the method will be operated by mixing active carbon with the fresh juice in mixing tank 23, with or without previous liming, and then introducing the mixed juice through sprays 168, 169 and 170 to the filter belt 16 (FIG. 2.) The filtered juice from pipes 165a will be water white and will be sent to heater 43, settling tank 44 and evaporator 46 to form syrup 47. This syrup is sent to vacuum pan 54, crystallizer 55, and centrifuge 58 to form direct white sugar 59 and edible molasses 61. With this manner of operating, the residue 17 delivered from filter belt 16 will contain all the field dirt. This residue will be dried and mixed with resin to produce a plastic molding compound. This residue will not be desirable for calcination to form active carbon as the ash would build up quite rapidly with repeated regenerations by calcination. This field dirt however will make a good mineral filler for the plastic molding composition, the bagacillo will be a fibrous filler to impart impact strength to the molded articles, and the wax will serve as a mold lubricant. In this case the active carbon used in the juice clarification will be made from bagasse plus lime by introducing this mixture into hopper 130 (FIG. 8). More vacuum boxes 166 may be used if desired.

A still simpler form of the method is to filter the cold fresh juice on filter belt 12 without any pretreatment of the juice. This filtration will remove all suspended matter from the juice including wax, leaving only soluble color to be removed. A reagent from the group $CO_2$, sucro blanc and/or oxalic acid is then mixed with the filtered juice to bleach all color to water white. The oxalic acid or $CO_2$ combines with any lime in the juice to form the insoluble precipites calcium oxalate and calcium carbonate respectively, which precipitates are removed from the juice by settling and decantation. The water white juice is then concentrated to a syrup by evaporation or reverse osmosis, the syrup is filtered with active carbon, and the syrup is then vacuum evaporated to make direct white sugar and edible molasses. No carbon is used on the juice with this method.

The above method may be further modified by liming the cold fresh juice to 7.5–8.5 pH before filtration to precipitate albuminoids and other non-sugar impurities. The filtered juice will then be near 7pH and suitable for concentration to a syrup.

If desired the water white juice from settling tank 44 may be used as a beverage 44a by diluting the juice with 2–3 parts by volume of water to reduce the sugar content to about 6%. The juice is then carbonated and bottled to form a bottled soft drink. Preservative, such as sodium benzoate, color and flavor may be added to the diluted juice before bottling if desired. This soft drink may be sold under the trademark Cana Cola or Cola de Cana in Latin American countries. Without added flavor, the beverage will have a delicate maple flavor of the fresh juice.

In the operation of the sugar process, to recover wax, the fresh juice is screened on belt screen 12 to remove bagacillo and some field dirt, is chlorinated, is settled in settler 20 to remove sand, is weighed, is limed to 7.5 – 8.5 pH and is then sent to combination settler filter 44. The lime precipitate of impurities including most of the wax is discharged from pipe 69, dried and extracted with heptane, hexane or acetone to recover the wax. The filtered juice from pipe 85 will then go to tower 28 to be treated with carbon for the purpose of removing the last of the impurities except for albumin and produce a water white juice. The juice then goes to heater 43, settling tank 44, and evaporator 46, the albumin being removed in settling tank 44.

In the purification and reclaiming of sewage plant effluent water, I mix hydrated lime to it to the extent of about 6 grams per gallon of the water. This throws down a voluminous precipitate of temporary hardness and the calcium derivative of a gum or organic compound of unknown composition, together with all the detergents in the water. The water is decanted from the precipitate in settling tank 44 (FIG. 3) which also filters the water in a single operation. This water is suitable for use in irrigation projects for growing vegetables and fruits or for chemical nutrient solution growing. Also the original effluent water may be used for this purpose before lime treatment. This lime addition also partly softens the effluent water by precipitating temporary hardness. Permanent hardness may be precipitated by the addition of soda ($Na_2CO_3$). This filtered water contains a slight amount of albumin which may be coagulated by heating the water by heat exchange and settled out in a combination settler and filter 44. This heating is done by heat transfer equipment so that little fuel is required. The heating also serves to sterilize the water and kill the bacteria which have not already been filtered from the water. The water may also be sterilized by chlorination if it is not desired to remove albumin by heating. The water may also be mixed with active carbon in tower 28, settled and filtered to make the water fit for reuse for domestic purposes by pumping it under ground to raise the water table. The carbon treatment removes any dead bacteria or organic taste and odor including any excess chlorine. The active carbon may be produced by the calcination of sludge dried in sludge beds, in the apparatus shown in FIGS. 8 and 9 with the recovery of valuable condensed by-products (FIG. 9). The mud produced in the treatment of the water may also be calcined to produce active carbon.

The sewage effluent water purified by my process can be returned to the ground water to replace the large amounts being pumped daily from wells for domestic uses. In a typical town like Aurora, Illinois, where I live, the sewage plant treats 18 million gal/day of sewage. This water is pumped from the ground and the water table is dropping 10ft per year. In the sub-divisions, the wells are being dug deeper and well casings are being extended to get down to the ever receding water table. In the sub-divisions on the edge of town that have individual wells, the people face a lack of water in three to five years which will make their homes uninhabitable due to the receding water table. My purified water would be returned to the ground by a perforated main into which the purified water would be pumped under pressure so that the water table would remain high. The sludge from the operation of the sewage plants can be dried and calcined to form active carbon for recycling and for sale to other industries. The volatile solvents driven off during calcination will form a valuable by-product. Less than lgram per quart of water evaporated of total solids, will be found in my treated water.

I would state in conclusion that while the examples illustrated and described constitute practical embodiments of my invention, I do not wish to limit myself precisely to these details, since manifestly, the same may be considerably varied without departing from the spirit of the invention as defined in the appended claims.

Having thus described my invention, I claim as new and desire to secure by Letters Patent;

1. The method of treating fresh sugar juice at about room temperature, which comprises removing non-sugar impurities from said juice to form a cold, water white juice, removing water from said water white juice by reverse osmosis to form a syrup, and evaporating said syrup to form direct white sugar and edible molasses.

2. The method of treating fresh sugar juice at about room temperature, which comprises mixing chlorine with said juice to sterilize said juice, removing non-sugar impurities from said juice to form a cold water white juice, removing water from said cold juice by reverse osmosis to form a syrup, and evaporating said syrup to form direct white sugar and edible molasses.

3. The method as described in claim 2 characterized in that said edible molasses has a natural maple flavor and odor.

4. The method of treating cane sugar juice, which comprises mixing oxalic acid solution with said juice at about room temperature to form a mud of non-sugar impurities, removing said mud from said juice and filtering said juice to form water white juice.

5. The method of treating cane sugar juice which comprises mixing oxalic acid with said juice to precipitate non-sugar impurities, mixing active carbon with said juice, and filtering said juice to produce water white juice.

6. The method as described in claim 5 characterized in that said water white juice is evaporated to form direct white sugar and edible molasses.

7. The method of treating unheated, fresh cane juice, which comprises removing non-sugar impurities from said juice to form a cold, water white juice, removing water from said water white juice by reverse osmosis to form a syrup, filtering said syrup in the presence of active carbon to form a water white syrup, and evaporating said syrup to form direct white sugar and edible molasses having a natural maple flavor and odor.

8. The step in the method of treating water white cane juice, which comprises subjecting said water white juice to reverse osmosis to concentrate said water white juice to syrup.

* * * * *